US006003707A

United States Patent [19]

Rensch

[11] Patent Number: 6,003,707

[45] Date of Patent: Dec. 21, 1999

[54] RECEPTACLE

[76] Inventor: Eberhard G. Rensch, Kurhausstrasse 8, CH-8032 Zürich, Switzerland

[21] Appl. No.: 09/156,539

[22] Filed: Sep. 17, 1998

[30] Foreign Application Priority Data

Sep. 18, 1997 [DE] Germany ..... 297 168 21U

[51] Int. Cl.[6] ..... B65D 27/00

[52] U.S. Cl. ..... 220/4.31; 220/326; 220/621; 220/622; 220/625

[58] Field of Search ..... 220/4.31, 4.28, 220/326, 621, 622, 625

[56] References Cited

U.S. PATENT DOCUMENTS

| | | | |
|---|---|---|---|
| 3,072,286 | 1/1963 | Cusumano | 220/326 |
| 3,109,420 | 11/1963 | Ott et al. | 220/4.31 |
| 4,171,058 | 10/1979 | Collins . | |
| 4,520,921 | 6/1985 | Vissing | 220/326 |
| 4,646,927 | 3/1987 | Williams et al. . | |
| 4,923,079 | 5/1990 | Foy | 220/326 |
| 4,944,424 | 7/1990 | Wood, Jr. | 220/326 |
| 5,704,508 | 1/1998 | Keip et al. | 220/4.31 |
| 5,803,295 | 9/1998 | Tussey | 220/4.31 |

*Primary Examiner*—Joseph M. Moy
*Attorney, Agent, or Firm*—Herbert Dubno

[57] ABSTRACT

A box is fitted together with a bottom of lateral walls, the latter being connected by mutually-engaging slots. The bottom has pins received in blind bores which engage in blind holes of the lateral walls. At least one of these pins is spring-biased to allow at least one lateral wall to be inserted. After the spring-biased pin jumps into the blind hold of this inserted wall, the pin and bore junctions are invisible and the system cannot be readily disassembled.

9 Claims, 3 Drawing Sheets

RECEPTACLE

FIELD OF THE INVENTION

My present invention relates to a receptacle and, more particularly to a receptacle having a plurality of lateral walls connected with a bottom and so constructed that, once assembled, the box cannot be readily disassembled. While in its broadest sense, the invention is not limited to any particular shape of the receptacle, in a narrower sense the invention can comprise a box having angularly adjoining walls and bottom and especially a rectangular box having two pairs of opposite walls and a substantially rectangular bottom.

BACKGROUND OF THE INVENTION

Box-like receptacles are available in a variety of configurations and materials and, where the box structure has been relatively easy to assemble, in most cases the joints facilitating such assembly have been exposed and the parts can be disassembled, usually in a reverse order to the assembling.

OBJECTS OF THE INVENTION

It is the principal object of the present invention to provide a receptacle, especially a box, which can be easily assembled and yet cannot be readily disassembled and will not have visible connecting members which prevent such assembly.

Another object of this invention is to provide a low-cost box structure, which can be composed of different materials and can have even different configurations, but which, once assembled, cannot be readily disassembled.

It is also an object of this invention to provide a box which can be fabricated from relatively simple parts and yet can reliably prevent disassembly.

SUMMARY OF THE INVENTION

These objects and others which will become apparent hereinafter are attained, in accordance with the invention, in a receptacle composed of lateral walls and a bottom received within lateral walls, wherein the bottom is provided along its peripheral edges with blind bores, from which short rod-like pieces or parts project, these rod-like pieces being referred to herein as pins. According to the invention, at least one of these pins is movable in the respective blind bore against the force of a spring and the lateral wall which are assembled by interfitting grooves formed in the lateral walls, include at least one lateral wall which is inserted upon pressing of the movable pin into its bore against the spring force so that that pin can subsequently spring out and engage in a blind hole and that lateral wall when the latter is in position, i.e. is engaged fully with the other lateral walls. Since the spring-biased pin is fully received in the blind bore of the bottom and the blind hole of the lateral wall which was shifted into engagement with the other lateral walls, that pin and the blind bores remain invisible at the junction between the bottom and the lateral wall.

According to the invention, moreover, the bottom can be provided with a plurality of blind bores which open toward the lateral wall and all receive respective rod-shaped parts or pins. The lateral walls have holes registering these blind bores upon assembly of the walls and the bottom so that the pins of the bottom are received in the blind bores of the lateral walls. While it is possible to operate with a single spring-loaded rod or pin, in practice two such spring-loaded rods or pins can be provided on opposite sides of the preferably rectangular bottom for engagement in respective lateral walls which are introduced from the bottom into other lateral walls previously engaged by pins of the bottom which are not spring-loaded. The bottom thus can have a pair of edges which may be the longitudinal edges in the case of an elongated bottom, whose blind bores receive fixed pins or rod-shaped parts engageable in corresponding blind holes of the longitudinal lateral walls of the box. The shorter edges of the bottom may be formed with blind bores for spring-loaded pins or rod-shaped parts which jump into the blind holes of the end lateral walls of the box when the latter are inserted into the longitudinal lateral walls.

The slot connection between the lateral walls can include downwardly-opening slots of the longitudinal lateral walls and upwardly opening longitudinal slots of the end lateral walls, the latter being inserted upwardly past the inwardly-pressed spring-loaded pins.

According to a feature of the invention, the spring-loaded pins or rod-shaped parts are designed to be pressed flush with the respective bottom edges, thereby facilitating the insertion of the and lateral walls.

According to a feature of the invention, a cover for the receptacle has a pair of fixed pins anchored in blind bores of the cover and receivable in blind holes of the lateral wall, thereby allowing the cover to pivot on the lateral walls.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
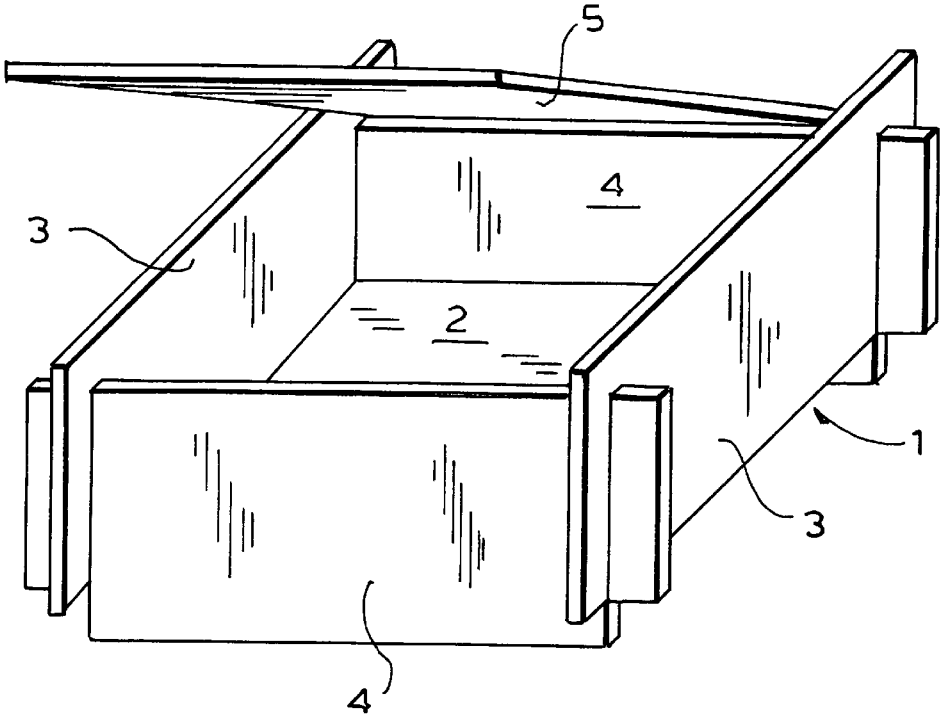
FIG. 1 is a perspective view of an assembled box according to the invention.
Figure 2:
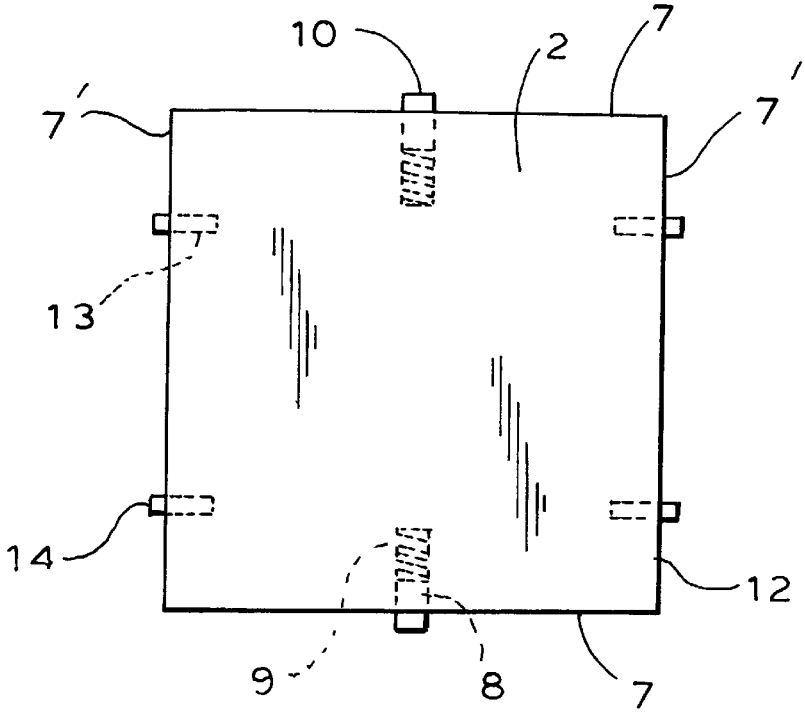
FIG. 2 is a plan view of the bottom before it is fitted with the lateral walls.

The box of FIG. 1 is formed from a bottom 2 which has edges 7 and 7'. The edges 7 are formed with blind bores 8 opening upwardly and receiving holding pins 10 biased outwardly by coil springs 9. The blind bores 8 and the springs 9 are dimensioned to enable the pins 10 to be pressed flush with the edges 7 of the bottom 2.

Figure 3:
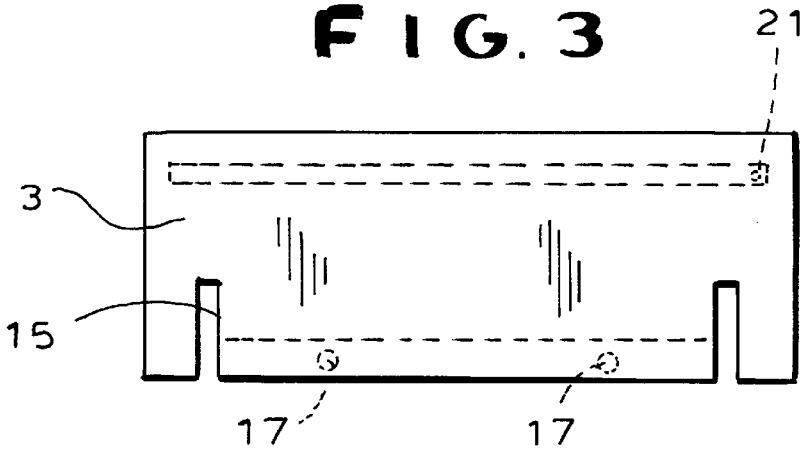
FIG. 3 is an elevational view of one of the lateral walls of the box.
Figure 4:
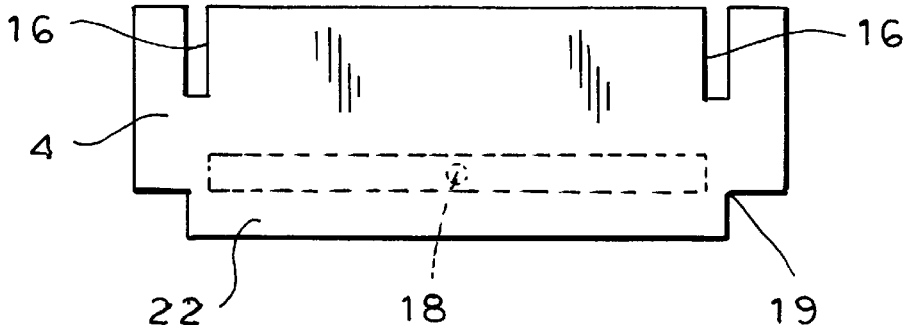
FIG. 4 is an elevational view of a lateral wall perpendicular to the lateral wall of FIG. 3.

The edges 7' are provided with blind bores 13 receiving fixed pins 14 which may be of a smaller diameter than the spring-loaded pins 10. Lateral walls 3 and 4 (FIGS. 3 and 4) are engageable with one another by downwardly open slots 15 and upwardly open slots 16, respectively, each slot extending at least 40% of the height of the respective lateral wall. The lateral walls 3 are formed with blind bores 17 alignable with blind bores 13 and dimensioned to snugly receive the pins 14 so that the pins 14 are fully concealed within the blind bores 13 and the blind holes 17. In addition, the walls 4 have blind holes 18 positioned and dimensioned to register with the blind bores 8 and to receive the pins 10.

In addition, the slots 3 have blind holes 21 adapted to receive the pins 20 which are engaged in blind bores 25 of the rectangular cover 5.

Figure 5:
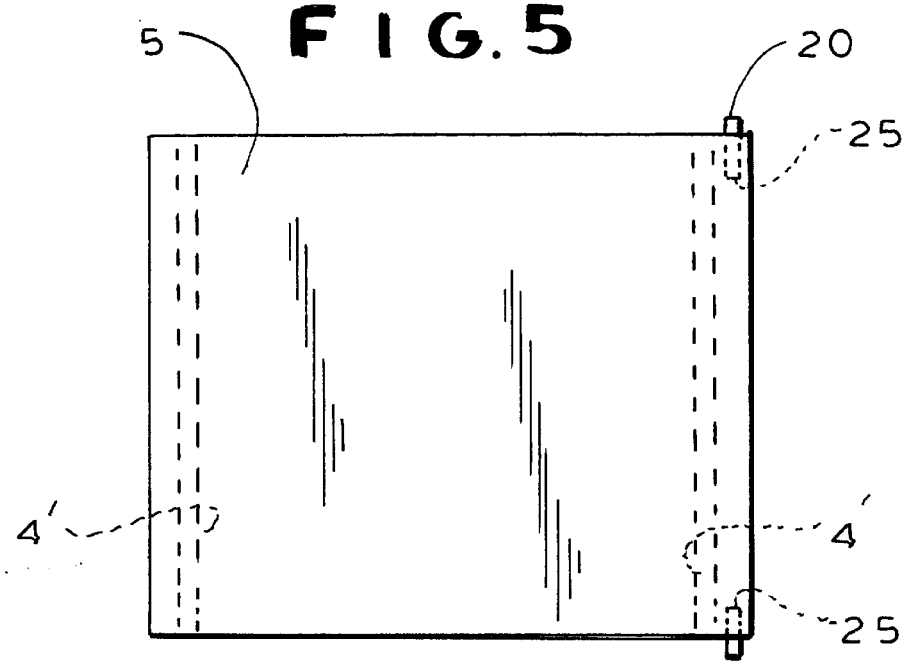
FIG. 5 is a plan view of the cover of the box.

The pins 10 have diameters which are greater than those of the pins 14 and the holes 14 are cut out at 19 to the configuration shown so that an apron 22 will extend below the lateral walls 3 upon assembly of the box and to act as feet for the box. The cover 15 is dimensioned to overlie the walls 4 as are represented by the broken line showings 4' in FIG. 5. The pins 14 are inserted into the blind bores 13 of the bottom 2 and the pins 20 are inserted into the blind bores 25 of the cover 5 respectively.

The box of FIG. 1 is assembled from the pieces of FIGS. 2–5 as follows:

The pins 14 are inserted into the blind holes 17 of the two lateral walls 3 and the pins 20 are inserted into the blind holes 21 thereof. The pins 10 are inserted into the blind bores 8 together with the springs 9 and are pressed inwardly while the lateral walls 4 are inserted upwardly into engagement with the lateral walls 3. The pins 10 are permitted to jump into the blind bores 18 of the lateral walls 4 and thus anchor the lateral walls in the position shown in FIG. 1. The box cannot be taken apart without destroying it since the pins are not exposed. The bottom 2 lies in the position shown by the broken line in FIG. 4 while the apron 22 functions as a support for the box. The cover 5 is received between the lateral walls 3 and can rest on the lateral walls 4.

The box of the invention does not use gluing or screws and cannot be disassembled in a simple way for the reasons noted.

Any suitable material can be used, including wood, stainless steel, precious metal or combinations of materials. The bottom, for example, may be made of wood or a polyacrylate while the other parts can be made of one of the metals mentioned. A stone bottom can also be used.

While the box has been shown to be of rectangular configuration utilizing a square bottom, other shapes can be used, including oval or circular bottoms as desired. In this case, the connecting slits and pins must be located appropriately.

Figure 6:
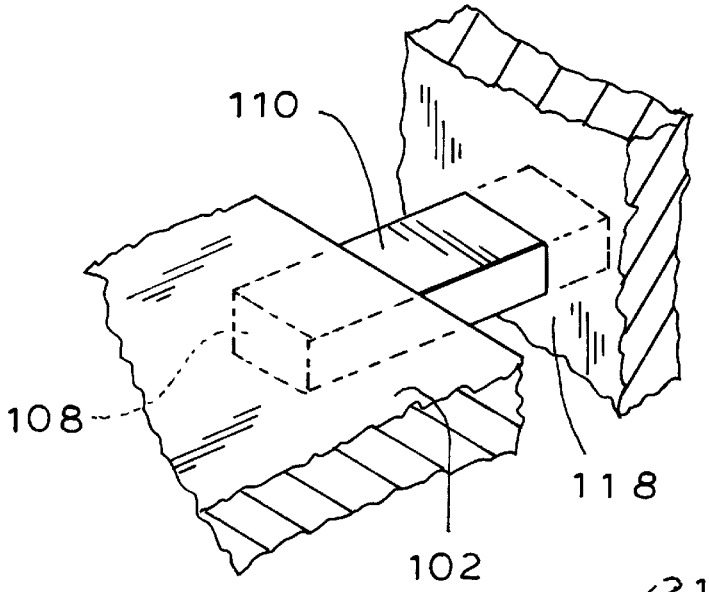
FIG. 6 is a perspective view of an embodiment of the invention in which rectangular cross section pins are used.

In FIG. 6 I have shown a system in which the pins 110 are of rectangular cross section and are received in blind bores 108 of the bottom 102 which are of like rectangular cross section. The springs received in these bores can be cylindrical helical compression springs as in FIGS. 1–5. The pins 110 can engage in blind holes 118 of corresponding rectangular cross section.

Figure 8:
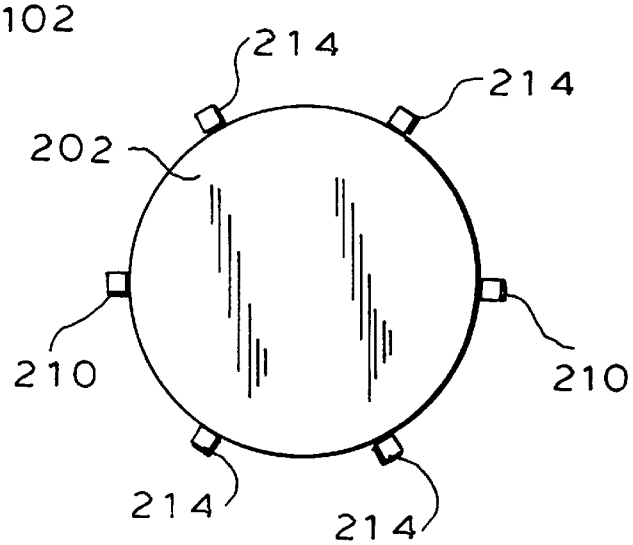
FIG. 8 is a plan view of a circular bottom according to the invention.

FIG. 8 shows that the bottom 202 can be of circular cross section with stationary pins 214 projecting radially from respective blind bores and inwardly movable pins 210 located on diametrically opposite sides of the bottom 202 a cylindrical wall can be assembled from cylinder segments analogous to the lateral wall formation shown in FIG. 1.

Figure 7:
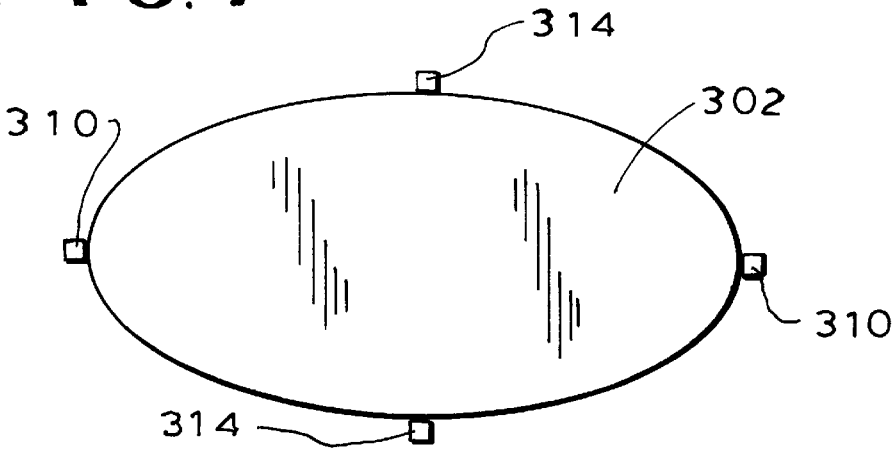
FIG. 7 is a plan view showing an oval bottom according to another embodiment of the invention.

The oval bottom can also be used as has been indicated at 302 in FIG. 7. Here the fixed pins 314 are located diametrically opposite one another and the inwardly movable pins 310 are diametrically opposite one another. An oval wall can be assembled from segments as indicated in FIG. 1 with the last segments being fed in place past the inwardly deflected pins 310 which then jump out to engage in bores in the lateral walls as have been described.

I claim:

1. A receptacle comprising a plurality of lateral walls connected together by interfitting slits formed in said lateral walls; a bottom received within said walls and formed with a plurality of blind bores opening toward said walls and receiving respective pins, respective blind holes formed in said lateral walls in registry with said blind bores of said bottom and engaged by said pins; and springs in at least some of said blind bores bearing upon movable pins thereof for urging same outwardly, whereby at least one of said movable pins can be urged into the respective bore against a force of a spring therein upon the fitting of one of said lateral walls into another of said lateral walls and jumps into the registering hole of said one of said one of said walls upon alignment therewith.

2. The receptacle defined in claim 1 wherein said bottom is rectangular and said lateral walls are provided in opposite pairs along mutually opposite lateral faces of said bottom, said springs being provided in blind bores opening at said lateral faces of two opposite sides of said bottom.

3. The receptacle defined in claim 2 wherein the pins engaged by said springs are of different diameters from pins received in blind bores free from said springs.

4. The receptacle defined in claim 2, further comprising a cover hinged by respective pins received in blind holes of two opposite lateral walls.

5. The receptacle defined in claim 2 wherein said pins and said blind holes have circular cross sections.

6. The receptacle defined in claim 2 wherein said pins and said blind holes have rectangular cross sections.

7. The receptacle defined in claim 1 wherein said bottom plate is circular.

8. The receptacle defined in claim 1 wherein said bottom plate is oval.

9. The receptacle defined in claim 1 wherein said slits extend over substantially 40% of a height of said lateral walls.

* * * * *